US008292004B2

(12) United States Patent
Buchanan et al.

(10) Patent No.: US 8,292,004 B2
(45) Date of Patent: Oct. 23, 2012

(54) DOWNHOLE MARKING APPARATUS AND METHODS

(75) Inventors: Steven E. Buchanan, Pearland, TX (US); Adam Walkingshaw, Houston, TX (US); Alex Slocum, Bow, NH (US); Gokhan Erol, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 295 days.

(21) Appl. No.: 12/784,149

(22) Filed: May 20, 2010

(65) Prior Publication Data

US 2011/0284289 A1 Nov. 24, 2011

(51) Int. Cl.
*E21B 25/16* (2006.01)
*E21B 49/02* (2006.01)

(52) U.S. Cl. ..... 175/44; 175/58; 175/249

(58) Field of Classification Search ..... 175/20, 175/44, 58, 226, 244, 246, 249; 166/264, 166/113; 73/864, 864.51, 864.91
See application file for complete search history.

(56) References Cited

U.S. PATENT DOCUMENTS 1,932,612 A * 10/1933 Williston ..... 175/44
2,859,938 A * 11/1958 Boucher ..... 175/44
4,714,119 A * 12/1987 Hebert et al. ..... 175/20
4,714,449 A 12/1987 Woerner et al.
5,310,013 A * 5/1994 Kishino et al. ..... 175/44
5,667,025 A 9/1997 Haessly et al.
6,371,221 B1 4/2002 Harrigan et al.
6,729,416 B2 5/2004 Contreras et al.
6,877,559 B2 * 4/2005 Hashem ..... 166/264
7,191,831 B2 3/2007 Reid et al.
7,293,715 B2 11/2007 Bargach et al.
7,303,011 B2 12/2007 Reid et al.
2005/0194134 A1 * 9/2005 McGregor et al. ..... 166/264
2006/0131376 A1 6/2006 Bargach et al.
2007/0205021 A1 * 9/2007 Pelletier et al. ..... 175/59
2009/0114447 A1 5/2009 Reid, Jr. et al.

OTHER PUBLICATIONS

International Search Report and Written Opinion dated Nov. 21, 2011 for corresponding PCT Application No. PCT/US2011/035333 filed May 5, 2011.

* cited by examiner

*Primary Examiner* — Kenneth L Thompson
(74) *Attorney, Agent, or Firm* — Cathy Hewitt; Michael Flynn; Jody DeStefanis

(57) ABSTRACT

Example downhole marking apparatus and methods to use the same are disclosed. A disclosed example apparatus includes a coring tool assembly for use in extracting a core sample from a subterranean formation adjacent a borehole; a sample container retainer operatively coupled to the coring tool assembly, wherein the sample container retainer is configured to hold a sample container configured to receive the core sample; and a scriber operatively coupled to the sample container retainer and configured to mark a surface of the sample container.

20 Claims, 6 Drawing Sheets

DOWNHOLE MARKING APPARATUS AND METHODS

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Some formation evaluation operations may include extracting one or more core samples from a sidewall of a borehole. Such core samples may be extracted using a coring assembly or tool that is part of a downhole tool, which may be conveyed via a wireline, drillstring, or in any other manner. Typically, multiple core samples are extracted from multiple locations along the borehole and stored in the downhole tool. The stored core samples may then be retrieved at the surface when the downhole tool is removed from the borehole and tested or otherwise evaluated to assess the locations corresponding to the core samples.

SUMMARY

The present disclosure relates to an apparatus that includes a coring tool assembly for use in extracting a core sample from a subterranean formation adjacent a borehole. The apparatus also includes a sample container retainer operatively coupled to the coring tool assembly and configured to hold a sample container configured to receive the core sample, and a scriber operatively coupled to the sample container retainer and configured to mark a surface of the sample container.

The present disclosure also relates to a method that includes extracting, via a downhole tool, a core sample from a subterranean formation adjacent a borehole, holding a sample container in the downhole tool to receive the core sample, depositing the core sample in the sample container, marking a surface of the sample container while the sample container is being held in the downhole tool, and moving the sample container holding the core sample to a storage location.

DETAILED DESCRIPTION

Figure 1:
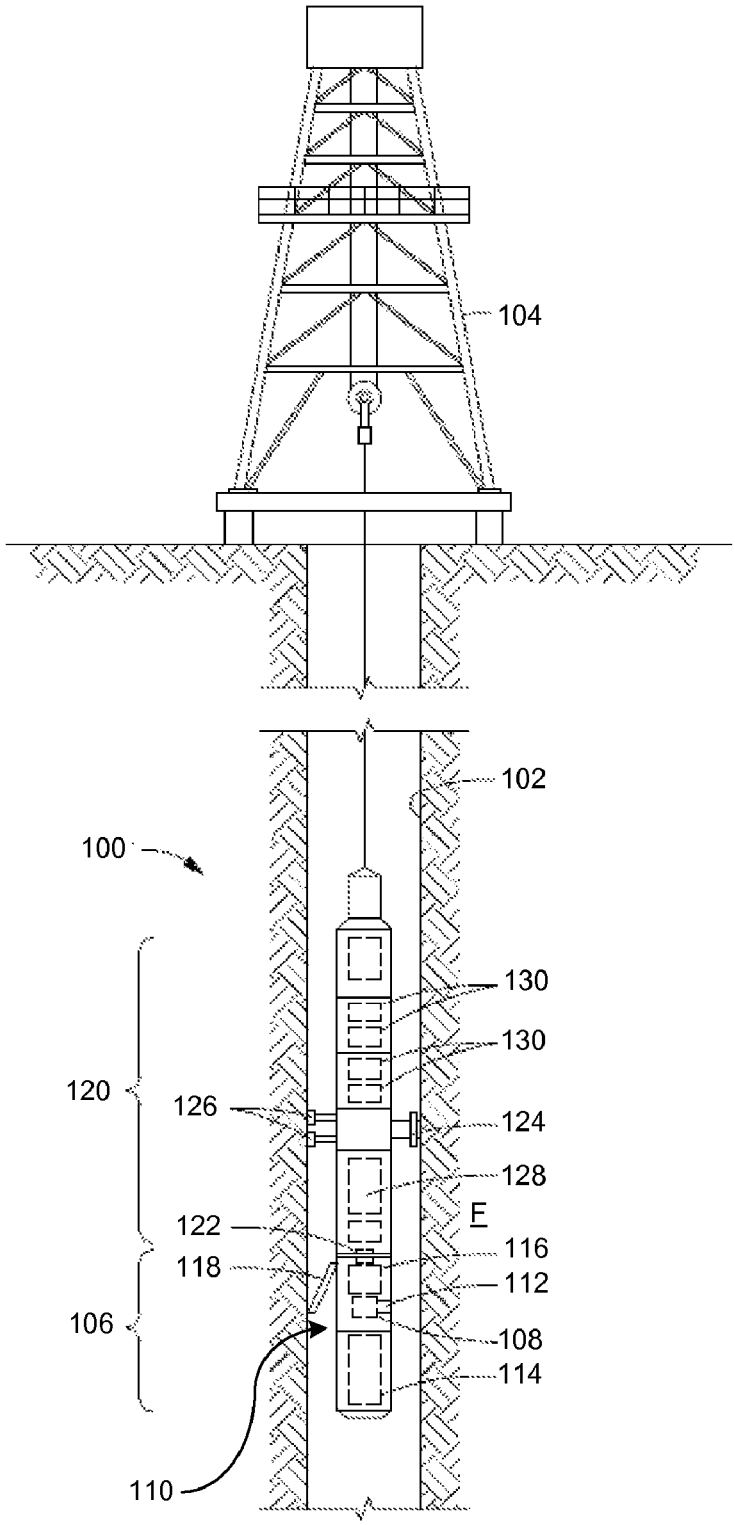
FIG. 1 is a schematic illustration of a wireline-deployed downhole tool or toolstring according to one or more aspects of the present disclosure.

Certain examples are shown in the above-identified figures and described in detail below. The figures are not necessarily to scale and certain features and certain views of the figures may be shown exaggerated in scale or in schematic for clarity and/or conciseness. It is to be understood that while the following disclosure provides many different embodiments or examples for implementing different features of various embodiments, other embodiments may be implemented and/or structural changes may be made without departing from the scope of this disclosure. Further, while specific examples of components and arrangements are described below these are, of course, merely examples and are not intended to be limiting. In addition, the present disclosure may repeat reference numerals and/or letters in the various examples. This repetition is for the purpose of clarity and does not in itself dictate a relationship between the various embodiments and/or example configurations discussed. Moreover, the depiction of a first feature over or on a second feature in the description that follows may include embodiments in which the first and second elements are implemented in direct contact, and may also include embodiments in which other elements may be interposed between the first and second elements, such that the first and second elements need not be in direct contact.

This disclosure relates to apparatus and methods for marking sample containers holding core samples extracted from subterranean formations. According to one or more aspects of this disclosure, a downhole tool may use a coring tool assembly to extract one or more core samples from one or more locations along a sidewall of a wellbore or borehole. A sample container holding apparatus or retainer may receive an empty sample container from a storage location within the downhole tool. The sample container retainer may be operatively coupled to the coring tool assembly and configured to apply sufficient force to the sample container to fixedly hold the empty sample container while a handling piston or other device moves a core sample from a hollow coring bit of the coring tool assembly to the sample container.

Once the core sample has been received by the sample container, the amount of force applied to the sample container by the sample container retainer may be reduced so that the sample container is still held by the sample container retainer, but so that the sample container can be pushed or otherwise moved out of the sample container retainer by the handling piston without damaging the core sample in the sample container. As the sample container is moved out of the sample container retainer toward the storage location by the handling piston, a marking unit or assembly such as a scriber operatively coupled to the sample container retainer engages or contacts a surface of the sample container. Specifically, as the sample container is moved past the scriber, the scriber marks (e.g., scores) the surface of the sample container with a line or other pattern.

The length of the line or other pattern imparted to the surface of the sample container may be varied or controlled so that the length of the line or other pattern corresponds uniquely to the core sample (e.g., the extraction location along the borehole) held by the sample container. In other words, the length of the line or other pattern may be used at the surface to correlate the sample container and the core sample it contains to a particular extraction location within the borehole.

To vary the length of the line or other pattern imparted or applied to the surface of the sample container by the scriber, the handling piston may move the sample container out of the sample container retainer (while the sample container retainer applies a force to the sample container to hold the sample container) at a predetermined rate for a predetermined time (i.e., along a predetermined length of the sample container). Alternatively or additionally, the scriber may be moved into contact with the surface for a predetermined amount of time while the handling piston moves the sample container out of the sample container retainer at a predetermined rate. Still further, the contact between the scriber and the surface of the sample container may be controlled by varying the force with which the sample container retainer holds the sample container as the handling piston moves the sample container out of the sample container retainer.

While the marks applied to the sample containers may be lines having different lengths, other types of marks may be used instead of or in addition to such lines. For example, the apparatus and methods described herein may apply a plurality of marks representing a code to each of the sample containers. In particular, a series of lines or dots in certain locations and/or lines having different lengths may be used to represent a code (e.g., a binary code) that corresponds uniquely to the sample container being marked. Further, the sample containers may include markings applied prior to use of the containers in the downhole tool. Such pre-applied markings may be graduation lines to facilitate determination of the length of the marks applied by the scriber and/or boxes or other features to facilitate reading of any code applied to the surface of the sample containers by the scriber. For example, each box or feature may correspond to a different power of two to facilitate reading of a binary code such as noted above.

The apparatus and methods described herein may be configured to apply one or more marks to one or more sample containers in a downhole tool. Each of the marks may correspond uniquely to a particular sample container and, thus, sample location, thereby enabling and greatly facilitating the tracking of samples retrieved at the surface for analysis. Additionally, while the example apparatus and methods described herein may be configured to mark every sample container to facilitate correlation of that sample container to a sample location during analysis at the surface, in some implementations only certain or selected sample containers may be marked. For example, as a sequence of sample containers are filled with samples and processed downhole, it may be desirable to mark containers based on their position within the sequence (e.g., every Nth container in the sequence). Also, for example, selected sample containers may be marked based on the sample container contents. For example, only containers having core samples that may be of particular interest may be marked.

Example coring tools and methods that may employ aspects of the example methods and apparatus described herein are described in U.S. Pat. No. 7,293,715, entitled "Marking System and Method," and issued on Nov. 13, 2007; U.S. Patent Publication No. 2009/0114447, entitled "Coring Tool and Method," and published May 7, 2009; U.S. Pat. No. 4,714,449, entitled "Apparatus for Hard Rock Sidewall Coring a Borehole," and issued on Dec. 22, 1987; and U.S. Pat. No. 5,667,025, entitled "Articulated Bit-Selector Coring Tool," and issued on Sep. 16, 1997, each of which is assigned to the assignee of the present application, and each of which is hereby incorporated by reference in its entirety.

While the example apparatus and methods described herein are described in the context of wireline tools, they are also applicable to any number and/or type(s) of additional and/or alternative downhole tools such as drillstring and coiled tubing deployed tools. Further, one or more aspects of this disclosure may also be used in other coring applications such as in-line coring.

FIG. 1 is a schematic illustration of a wireline downhole tool or toolstring 100 deployed in a borehole 102 and suspended from a rig 104 according to one or more aspects of the present disclosure. The toolstring 100 includes a core sampling assembly 106 having a coring tool assembly 108, which includes a coring bit assembly 110 having a coring bit 112. The core sampling assembly 106 further includes a storage location or area 114 for storing core samples, and associated actuation mechanisms 116. The storage location or area 114 is configured to receive sample cores, which may be disposed in a sleeve, canister or, more generally, a sample container or other sample holder. At least one brace arm 118 may be provided to stabilize the toolstring 100 in the borehole 102 while the coring bit 112 is extracting a core sample.

The toolstring 100 may further include additional systems for performing other functions. One such additional system is illustrated in FIG. 1 as a formation testing tool 120 that is operatively coupled to the core sampling assembly 106 via a field joint 122. The formation testing tool 120 may include a probe 124 that is extended from the formation testing tool 120 to be in fluid communication with a formation F. Back up pistons 126 may be included in the toolstring 100 to assist in pushing the probe 124 into contact with the sidewall of the borehole 102 and to stabilize the toolstring 100 in the borehole 102.

The formation testing tool 120 shown in FIG. 1 also includes a pump 128 for pumping sample fluid, as well as sample chambers 130 for storing fluid samples. The locations of these components are only schematically shown in FIG. 1 and, thus, may be provided in locations within the toolstring 100 other than those illustrated. Other components such as a power module, a hydraulic module, a fluid analyzer module, and other devices may also be included.

The example apparatus of FIG. 1 is depicted as having multiple modules operatively connected together. However, the example apparatus may also be partially or completely unitary. For example, as shown in FIG. 1, the formation testing tool 120 may be unitary, with the core sampling assembly 106 housed in a separate module operatively connected by the field joint 122. Alternatively, the core sampling assembly 106 may be unitarily included within the overall housing of the toolstring 100.

Figure 2:
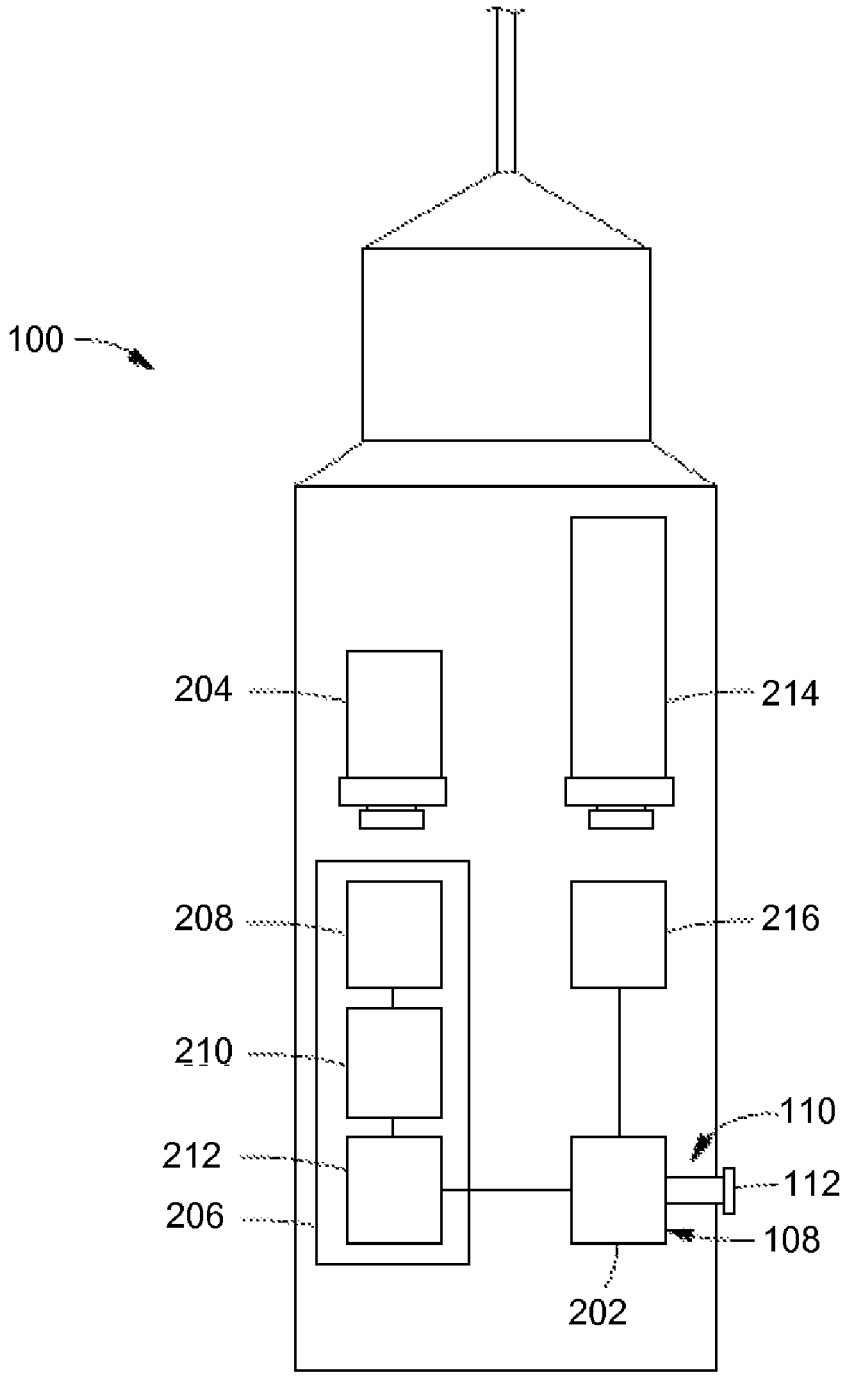
FIG. 2 is an enlarged schematic illustration of a core sampling assembly according to one or more aspects of the present disclosure.

FIG. 2 is an enlarged schematic illustration of the core sampling assembly 106 of FIG. 1 according to one or more aspects of the present disclosure. As noted above, the core sampling assembly 106 includes the coring assembly 108 with the coring bit 112. A hydraulic coring motor 202 is operatively coupled to rotationally drive the coring bit 112 to cut into the formation F and obtain a core sample.

To drive the coring bit 121 into the formation F, the coring bit 121 is pressed into the formation F while the bit 112 rotates. Thus, the core sampling assembly 106 applies a weight-on-bit (WOB), which is a force that presses the coring bit 112 into the formation F, and a torque to the coring bit 112. FIG. 2 schematically depicts mechanisms for applying both of these forces. For example, the WOB may be generated by a motor 204, which may be an alternating current (AC), brushless direct current (DC), or other power source, and a control assembly 206. The control assembly 206 may include a hydraulic pump 208, a feedback flow control valve 210, and a piston 212. The motor 204 supplies power to the hydraulic pump 208, while the flow of hydraulic fluid from the pump 208 is regulated by the feedback flow control valve 210. The pressure of the hydraulic fluid drives the piston 212 to apply a WOB to the coring bit 112.

Torque may be supplied to the coring bit 112 by a second motor 214, which may be an AC, brushless DC, or other power source, and a gear pump 216. The second motor 214 drives the gear pump 216, which supplies a flow of hydraulic fluid to the hydraulic coring motor 202. The hydraulic coring motor 202, in turn, imparts a torque to the coring bit 112 that causes the coring bit 112 to rotate against the formation F.

While specific examples of the mechanisms for applying WOB and torque are provided above, any known mechanisms for generating such forces may be used without departing from the scope of this disclosure. Additional examples of mechanisms that may be used to apply WOB and torque are disclosed in U.S. Pat. Nos. 6,371,221 and 7,191,831, both of which are assigned to the assignee of the present application and are incorporated herein by reference in their entireties.

Figure 3:
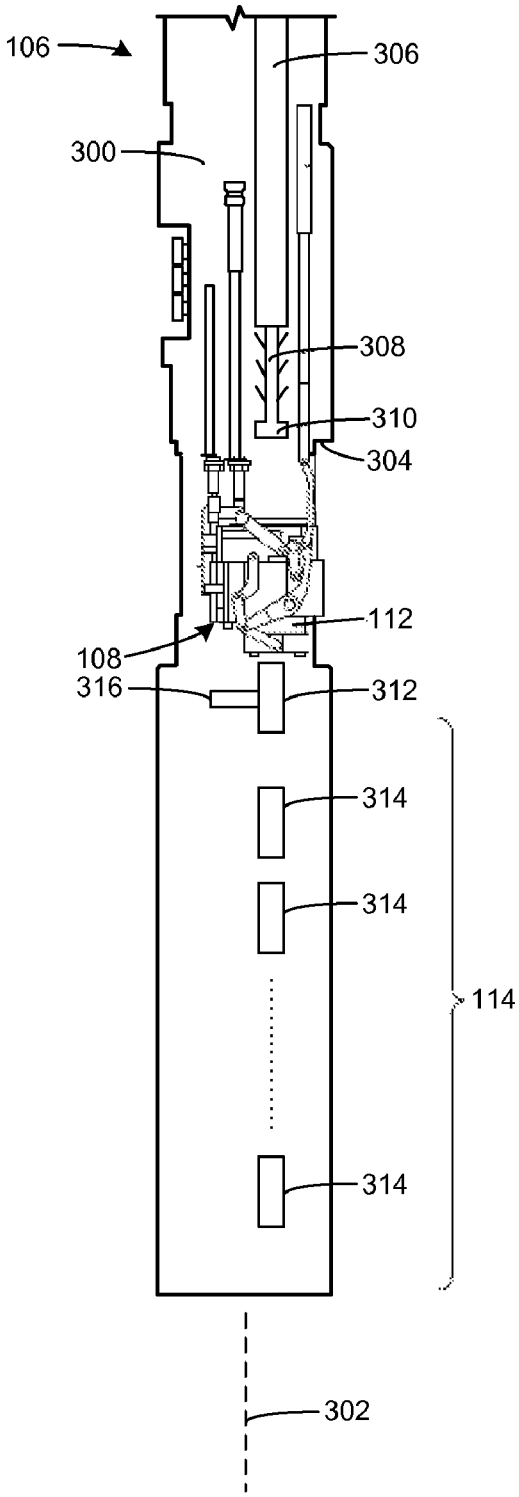
FIG. 3 is a detailed schematic diagram of a core sampling assembly according to one or more aspects of the present disclosure.

FIG. 3 is a more detailed schematic diagram of the core sampling assembly 106 of FIGS. 1 and 2 according to one or more aspects of the present disclosure. The core sampling assembly 106 includes a tool body or housing 300 having a longitudinal axis 302. The tool housing 300 defines a coring aperture 304 through which core samples are retrieved via the coring tool assembly 108. The coring tool assembly 108 is coupled to the tool housing 300 to enable the coring tool assembly 108 to rotate and extend the coring bit 112 through the coring aperture 304 of the tool housing 300 and into contact with a formation from which a core sample is to be extracted.

In operation, a handling piston 306 extends a gripper brush 308 having a foot or head 310 through the coring tool assembly 108, a core transfer tube 312 and into the storage area 114. The storage area 114 may contain a plurality core sample containers 314, some of which may be empty and others of which may have core samples stored therein. Thus, the foot 310 and gripper brush 308 may extend into an opening of an empty core sample container 314 to couple the sample container 314 to the handling piston 306. The handling piston 306 is then retracted to move the empty sample container 314 into the core transfer tube 312. A sample container retainer 316 coupled to the core transfer tube 312 may then be engaged to firmly hold the empty sample container 314 within the core transfer tube 312. While the empty sample container 314 is held by the sample container retainer 316 within the core transfer tube 312, the handling piston 306 is further retracted out of engagement with the empty sample container 314, through the coring tool assembly 108 and returned to the position depicted in FIG. 3.

The coring tool assembly 108 is then rotated and translated through the coring aperture 304 to engage the coring bit 112 with the location of the formation from which a core sample is to be extracted. Once the coring bit 112 has extracted a core sample, the coring tool assembly 108 rotates back into the position shown in FIG. 3 and the handling piston 306 is again extended so that the foot 310 moves or pushes the core sample out of the coring tool assembly 108 and into the sample container 314 held in the core transfer tube 312. Once the core sample has been deposited in the core sample container 314 held in the core transfer tube 312, a force applied by the sample container retainer 316 to the sample container therein may be reduced to continue to frictionally engage and hold the sample container 314, but allow movement of the sample container 314 relative to the sample container retainer 316 in response to force applied by the handling piston 306. This reduced force may be selected so that a scriber 412 (FIG. 4), which is described below in greater detail in connection with FIG. 4 and which is operatively coupled to the sample container retainer 316, is maintained in contact with a surface (e.g., an outer surface) of the sample container 314 within the core transfer tube 312. Additionally, this reduced force enables the handling piston 306 to continue to move the sample container 314 toward the storage area 114 without causing damage to the core sample held within the sample container 314 and without causing any substantial damage to the sample container 314.

The handling piston 306 may be controlled to move the sample container 314 away from the sample container retainer 316 while the reduced amount of force is being applied to the sample container 314 at a predetermined rate and for a predetermined amount of time, thereby forming a mark (e.g., a vertical score line or scratch) having a known controlled length on the surface of the sample container 314. As described in greater detail below, the length of the mark on the sample container 314 may correspond uniquely to that container, the sample contents of the container, and the location along the borehole from which the sample was extracted. As a result, the length of the line may be measured at the surface to accurately correlate the core sample held in the sample container 314 to a borehole or formation location. In any event, once the desired mark has been formed on the surface of the sample container 314, the force applied by the sample container retainer 314 may be further reduced to prevent further marking of the sample container 314, and the handling piston 306 may be configured to move the marked sample container 314 toward the storage area 114 for storage with other sample containers 314.

The foregoing sample collection and sample container marking process may be repeated for any number of collected samples. Further, by varying the time for which and/or the rate at which the handling piston 306 moves the sample containers 314 while the holding force of the sample container retainer 316 is set to enable marking of the sample containers 314 by the scriber 412 (FIG. 4), each sample container 314 may receive a unique marking to uniquely identify that sample container 314. For example, each of the sample containers 314 may be marked with a line or other pattern having a different length. Alternatively, each of the sample containers 314 may be marked with multiple lines or other patterns to form a code. For example, line segments or other marks may be selectively formed at one or more predefined locations or positions along the length of the sample container 314 such that each of the predefined locations or positions corresponds to a numerical value. Such positions could, for instance, correspond to powers of two, thereby enabling a binary code to be marked on the sample containers 314. In the case of such a binary code, the line segments or other marks may be of equal length. However, other codes involving different combinations of mark lengths and positions could be used instead without departing from the scope of the present disclosure.

While the examples above describe each of the sample containers 314 as being marked, other implementations may include selectively marking only certain sample containers. For example, certain sample containers may be marked based on their position within a sequence of sample containers (e.g., every Nth container). Alternatively or additionally, only containers of particular interest may be marked (e.g., based on the core sample and/or the location from which the core sample was extracted). Further, any other manner of selectively marking the sample containers may be employed to suit the needs of a particular application.

Figure 4:
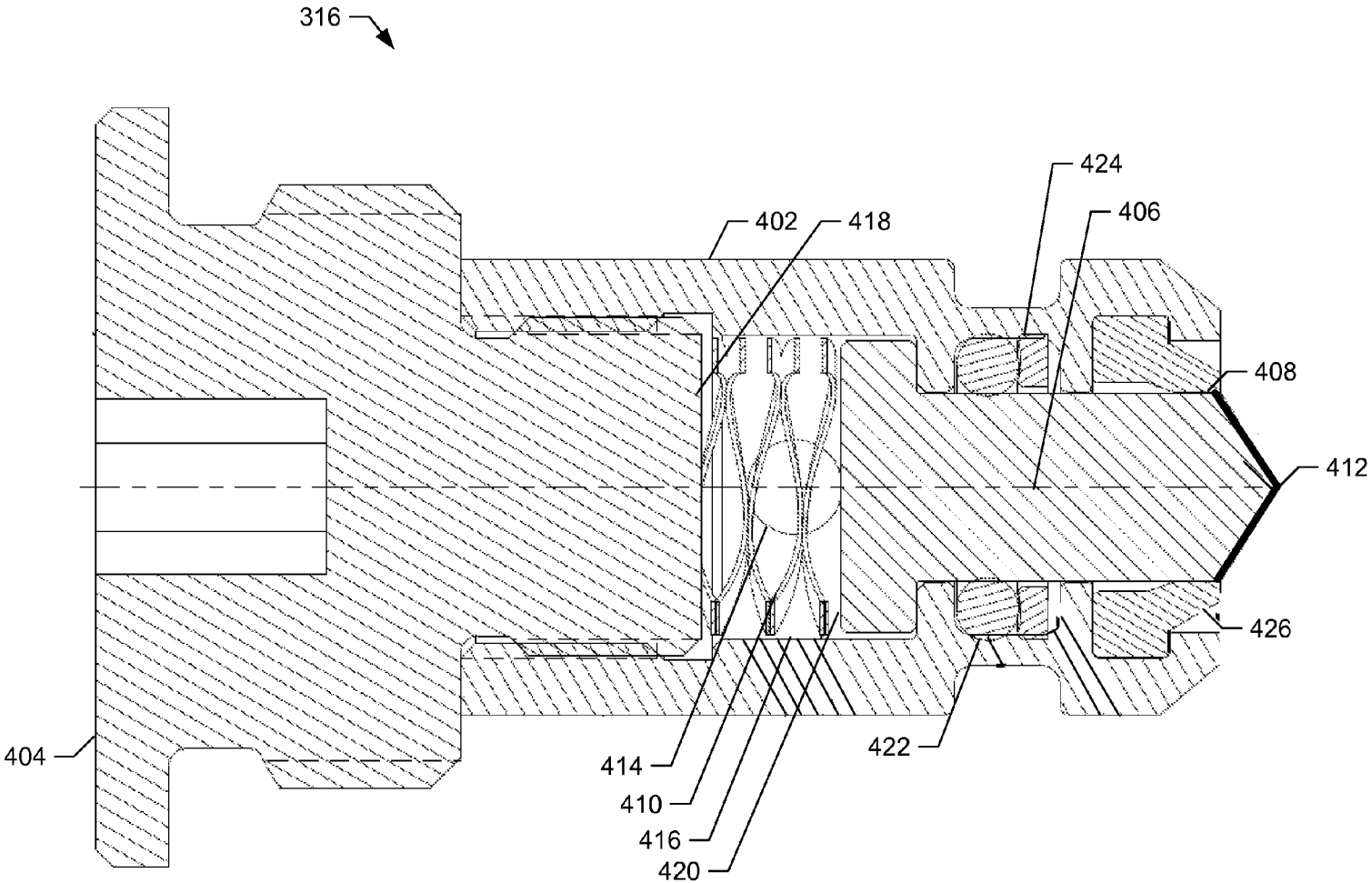
FIG. 4 is a cross-sectional view of an example sample container holding and marking apparatus according to one or more aspects of the present disclosure.

FIG. 4 is a cross-sectional view of an example manner of implementing the sample container retainer 316 of FIG. 3 in accordance with one or more aspects of the present disclosure. The example sample container retainer 316 includes a housing 402 and a cap 404 that may be threadably engaged with the housing 402. An actuator, piston or pin 406 is slidably engaged with a bore 408 of the housing 402 and is springably biased by a spring 410. The spring 410 is depicted as a wave spring, but a coil spring or any other type of biasing element could be used instead. The piston 406 has a relatively pointed or sharpened tip 412, which functions as a scriber when in contact with a surface of a sample container. The piston 406 may be made of a relatively hard ceramic and/or metallic material to provide a long-lasting, effective scribing function. While the piston 406 is depicted as a unitary structure, the piston 406 could, alternatively, be made of multiple components and/or materials. For example, the tip 412 could be made of one material that is best-suited for scribing and wear resistance (e.g., ceramic) and the body of the piston 406 could be made of a relatively softer material (e.g., stainless steel).

The body 402 further includes a port 414 to receive a pressurized fluid (e.g., hydraulic fluid) in a chamber 416 between an end 418 of the cap 404 and a head 420 of the piston 406. The amount of hydraulic pressure applied to the chamber 416 can be varied to control the force with which the tip 412 pushes against a surface of a sample container. As noted above, such force may be set at one level to hold a sample container while the sample container is loaded with a core sample, while a relatively lower force may be applied to the sample container to enable movement of the sample container against the tip 412 and, thus, marking (e.g., scribing) of a surface of the sample container with an identifying mark.

A seal ring (e.g., an o-ring) 422 and backup ring 424 (e.g., to prevent extrusion of the o-ring 422) are included to isolate the chamber 416 and to prevent the escape of hydraulic fluid therefrom. A wiper 426 may also be provided to prevent the ingress of contaminates into the bore 408 during movement of the piston 406.

The example sample container retainer 316 of FIG. 4 is depicted as being hydraulically actuated, but such a retainer could alternatively or additionally employ electrical and/or electromechanical actuation. Further, while the example sample container retainer 316 is depicted as being mounted or coupled to the core transfer tube 312, the sample container retainer 316 could be mounted within the core sampling assembly 106 (FIGS. 1-3) in other manners and/or locations without departing from the scope of the present disclosure. Still further, while the example described in connection with FIGS. 1-3 includes only one sample container retainer 316, other implementations could include multiple sample container retainers 316. In the case wherein multiple sample container retainers are employed, sample containers could be marked (e.g., simultaneously) at multiple longitudinal and/or radial positions distributed over the surface of the sample container. Such marking capability may enable more complex marking schemes and, thus, more complex sample container identification or tracking schemes.

Figure 5A:
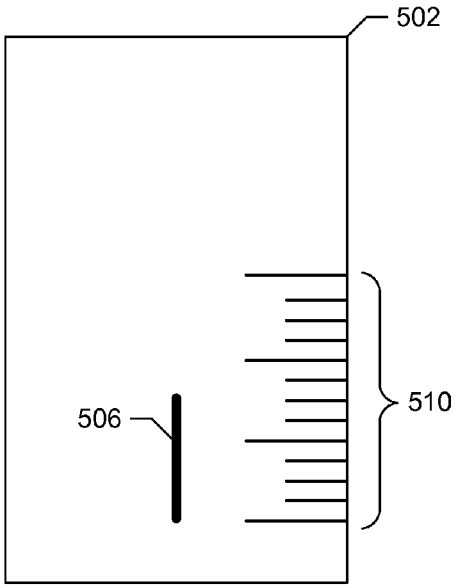
FIGS. 5A and 5B depict example sample containers according to one or more aspects of the present disclosure.
Figure 5B:
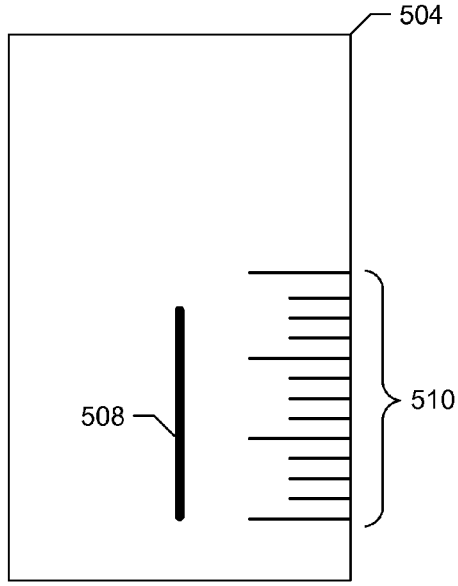

FIGS. 5A and 5B depict example marked sample containers 502 and 504 according to one or more aspects of the present disclosure. The example containers 502 and 504 may be made of a metallic material, a plastic material, and/or a composite material. The example sample containers 502 and 504 are depicted as having been marked using the apparatus described herein with respective marks 506 and 508. In the examples of FIGS. 5A and 5B, the marks 506 and 508 are depicted as lines of different lengths, where each line length corresponds uniquely to its respective sample container and the location from which the core sample was extracted. To facilitate determination of the different line lengths, the example sample containers 502 and 504 include graduation markings or lines, where each of the graduation lines may be a predetermined (e.g., an equal or varying) distance from one or more immediately adjacent lines. Thus, in use, an operator and/or a machine at the surface may view or read the length of the marks 506 and 508 relative to the graduation lines 510 to quickly determine, for example, the order in and the locations from which core samples in the sample containers 502 and 504 were collected.

The graduation lines 510 may be applied to the sample containers 502 and 504 prior to their use downhole for collecting core samples. Such lines 510 may be integrally formed in the containers (e.g., during a manufacturing process), applied (e.g., via printing operations), a decal that is applied to the containers 502 and 504, painted on the containers 502 and 504, or applied in any other manner.

Figure 6A:
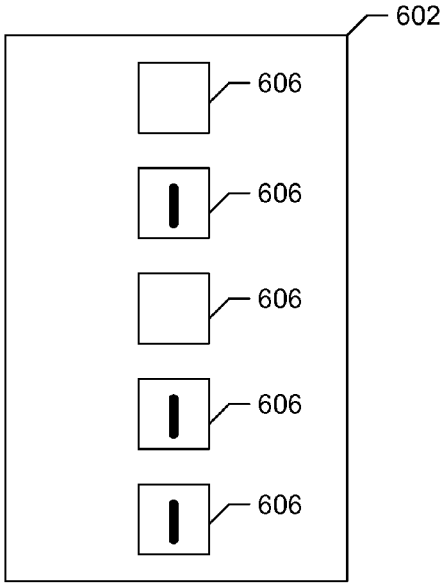
FIGS. 6A and 6B depict alternative example sample containers according to one or more aspects of the present disclosure.
Figure 6B:
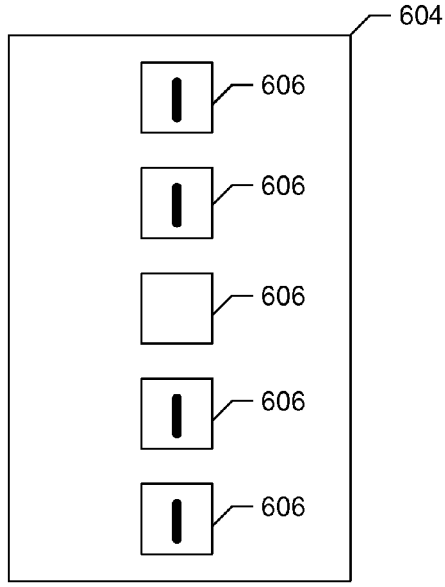

FIGS. 6A and 6B depict alternative example marked sample containers 602 and 604 according to one or more aspects of the present disclosure. The example sample containers 602 and 604 include outlined areas or boxes 606 that may be applied to the sample containers 602 and 604 prior to their use downhole. Such outlined areas or boxes 606 may be applied in manners similar to those set forth above in connection with the graduation lines 510 (FIG. 5). In use, marks (e.g., line segments) may be made in one or more of the boxes 606 to encode a unique identifier on each of the sample containers 602 and 604. If the boxes 606 on a given sample container represent increasing powers of two, then the encoding may represent a binary number. For example, in that case, the example sample containers 602 and 604 are encoded with the sequential binary numbers 11010 and 11011, respectively.

Figure 7A:
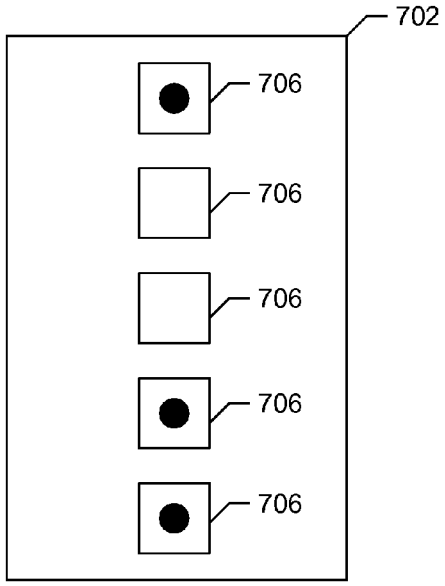
FIGS. 7A and 7B depict further alternative example sample containers according to one or more aspects of the present disclosure.
Figure 7B:
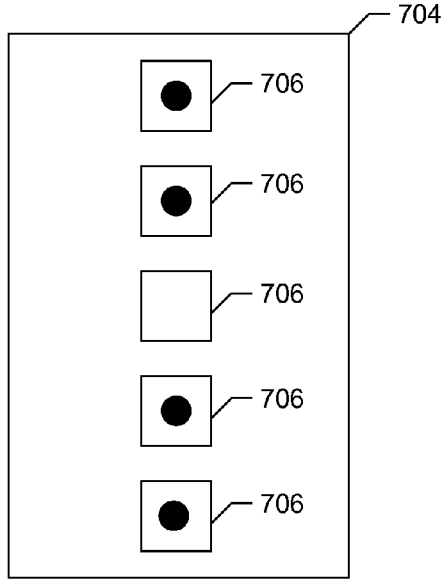

FIGS. 7A and 7B depict alternative example marked sample containers 702 and 704 according to one or more aspects of the present disclosure. Similar to the containers 602 and 604 of FIGS. 6A and 6B, the example sample containers 702 and 704 include outlined areas or boxes 706 that may be applied to the sample containers 702 and 704 prior to their use downhole. Such outlined areas or boxes 706 may be applied in manners similar to those set forth above in connection with the graduation lines 510 (FIG. 5). In use, marks such as circles or dots may be made in one or more of the boxes 706 to encode a unique identifier on each of the sample containers 702 and 704. If the boxes 706 on a given sample container represent increasing powers of two, then the encoding may represent a binary number. For example, in that case, the example sample containers 702 and 704 are encoded with the sequential binary numbers 11010 and 11011, respectively.

The marks applied to the sample containers 602, 604, 702 and 704 of FIGS. 6A, 6B, 7A and 7B, respectively, may be formed using one or more sample container retainers and/or one or more scribers. For example, as noted above, multiple scribers, marking devices or apparatus may enable simultaneous marking of a sample container at multiple longitudinal and/or radial locations distributed across the surface of the sample container. Further, while certain examples described above involve the movement of the sample containers relative to the scriber(s) to form the marks on the surfaces of the sample containers, in other implementations, the scriber may instead form the marks by sufficient pressure applied to the scribers to indent or otherwise impress a mark or marks on the surfaces of the sample containers. Thus, in those implementations, the sample containers are marked before they are moved to a storage location, but do not have to be moved while being held by the sample container retainer to mark the sample containers.

Also, while the examples described herein involve placing a relatively permanent mark on the surface of a sample container via, for example, a scriber that scores or scratches a surface of the sample container, other manners of applying a semi-permanent mark to the surface of a sample container may be used instead. For example, a sacrificial layer of material (e.g., a metal foil, paint, or other coating) may be adhered or otherwise fixed to the outer surface of the sample container and that sacrificial layer of material may be marked in the manners described above. Once marked, such a sample container could be re-used by removing and/or replacing the sacrificial layer to provide a clean, unmarked outer surface to the sample container.

In view of all of the above and the Figures, it should be clear that the present disclosure introduces an apparatus comprising: a coring tool assembly for use in extracting a core sample from a subterranean formation adjacent a borehole; a sample container retainer operatively coupled to the coring tool assembly and configured to hold a sample container configured to receive the core sample; and a scriber operatively coupled to the sample container retainer and configured to mark a surface of the sample container. The scriber may be formed on an actuator of the sample container retainer. The scriber may be configured to mark the surface of the sample container with at least one mark having a length corresponding to a location of the borehole from which the core sample was extracted. The scriber may be configured to mark a surface of another sample container with another mark having a different length corresponding to another location of the borehole from which the other core sample was extracted. The length of each of the marks may correspond uniquely to its respective location. The scriber may be configured to impart a plurality of marks to the surface of the sample container, the marks collectively forming a code corresponding to a location of the borehole from which the core sample was extracted. Each of the marks may have a different length and the code may be a binary code corresponding uniquely to the location. The scriber may comprise at least one of a ceramic or a metallic material to score the surface of the sample container. The sample container may comprise at least one of a metallic, plastic or a composite material. The sample container retainer may be at least one of electrically actuated, hydraulically actuated, or electromechanically actuated. The sample container may comprise markings prior to the sample container being used in the borehole, and the markings may comprise at least one of graduation lines to facilitate determination of a length of the mark or boxes to facilitate reading of a code represented by the mark.

The present disclosure also introduces a method comprising: extracting, via a downhole tool, a core sample from a subterranean formation adjacent a borehole; holding a sample container in the downhole tool to receive the core sample; depositing the core sample in the sample container; marking a surface of the sample container while the sample container is being held in the downhole tool; and moving the sample container holding the core sample to a storage location. Moving the sample container holding the core sample may comprise reducing a holding force applied to the sample container for a particular amount of time to enable movement of the sample container and simultaneous marking of the sample container. Marking the surface of the sample container may comprise marking the surface of the sample container with at least one mark having a length corresponding to a location from which the core sample was extracted. The method may further comprise marking another sample container holding another core sample to have another mark having a different length corresponding to another location from which the other core sample was extracted. The length of each of the marks may correspond uniquely to its respective location. Marking the surface of the sample container may comprise imparting a plurality of marks to the sample container, the marks collectively forming a code corresponding to a location from which the core sample was extracted. Each of the marks may have a different length and the code may be a binary code corresponding uniquely to the location. The method may further comprise marking a plurality of sample containers, wherein the marking may impart one or more marks to each of the sample containers. The marked sample containers may be selected from a sequence of sample containers. The selected sample containers may be selected based on their position within the sequence. The selected sample containers may be selected based on the core samples stored within the selected sample containers.

The present disclosure also introduces a system comprising: a downhole tool including a core sampling assembly; a sample container holding apparatus operatively coupled to the core sampling assembly, wherein the sample container holding apparatus is configured to hold a sample container configured to receive a core sample; and a marking apparatus operatively coupled to the sample container holding apparatus, wherein the marking apparatus is configured to mark a surface of the sample container before the sample container is conveyed to a storage location in the downhole tool. The marking apparatus may be configured to scribe a line on the surface of the sample container before the sample container is conveyed to the storage location in the downhole tool, and wherein the line may have a length corresponding to a location from which the core sample was extracted. The marking apparatus may be configured to scribe a code on the surface of the sample container before the sample container is conveyed to the storage location in the downhole tool. The code may comprise a binary code that corresponds uniquely to a location from which the core sample was extracted. The downhole tool may be configured to be conveyed via at least one of a wireline or a drillstring.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a coring tool assembly for use in extracting a core sample from a subterranean formation adjacent a borehole;

a sample container retainer operatively coupled to the coring tool assembly and configured to hold a sample container configured to receive the core sample; and a scriber operatively coupled to the sample container retainer and configured to mark a surface of the sample container.

2. The apparatus of claim 1 wherein the scriber is formed on an actuator of the sample container retainer.

3. The apparatus of claim 1 wherein the scriber is configured to mark the surface of the sample container with at least one mark having a length corresponding to a location of the borehole from which the core sample was extracted.

4. The apparatus of claim 3 wherein the scriber is configured to mark a surface of another sample container with another mark having a different length corresponding to another location of the borehole from which the other core sample was extracted.

5. The apparatus of claim 4 wherein the length of each of the marks corresponds uniquely to its respective location.

6. The apparatus of claim 1 wherein the scriber is configured to impart a plurality of marks to the surface of the sample container, the marks collectively forming a code corresponding to a location of the borehole from which the core sample was extracted.

7. The apparatus of claim 6 wherein each of the marks has a different length and the code is a binary code corresponding uniquely to the location.

8. The apparatus of claim 1 wherein the scriber comprises at least one of a ceramic or a metallic material to score the surface of the sample container.

9. The apparatus of claim 1 wherein the sample container comprises at least one of a metallic, plastic or a composite material.

10. The apparatus of claim 1 wherein the sample container comprises markings prior to the sample container being used in the borehole, and wherein the markings comprise at least one of graduation lines to facilitate determination of a length of the mark or boxes to facilitate reading of a code represented by the mark.

11. A method, comprising:

extracting, via a downhole tool, a core sample from a subterranean formation adjacent a borehole;

holding a sample container in the downhole tool to receive the core sample;

depositing the core sample in the sample container;

marking a surface of the sample container while the sample container is being held in the downhole tool; and moving the sample container holding the core sample to a storage location.

12. The method of claim 11 wherein moving the sample container holding the core sample comprises reducing a holding force applied to the sample container for a particular amount of time to enable movement of the sample container and simultaneous marking of the sample container.

13. The method of claim 11 wherein marking the surface of the sample container comprises marking the surface of the sample container with at least one mark having a length corresponding to a location from which the core sample was extracted.

14. The method of claim 13 further comprising marking another sample container holding another core sample to have another mark having a different length corresponding to another location from which the other core sample was extracted.

15. The method of claim 14 wherein the length of each of the marks corresponds uniquely to its respective location.

16. The method of claim 11 wherein marking the surface of the sample container comprises imparting a plurality of marks to the sample container, the marks collectively forming a code corresponding to a location from which the core sample was extracted.

17. The method of claim 16 wherein each of the marks has a different length and the code is a binary code corresponding uniquely to the location.

18. The method of claim 12 further comprising marking a plurality of sample containers, wherein the marking imparts one or more marks to each of the sample containers.

19. The method of claim 18 wherein the marked sample containers are selected from a sequence of sample containers based on their position within the sequence.

20. The method of claim 18 wherein the marked sample containers are selected from a sequence of sample containers based on the core samples stored within the selected sample containers.

* * * * *